United States Patent [19]

Delligatti

[11] 4,037,529

[45] July 26, 1977

[54] BOTTOM CODERS

[76] Inventor: Patrick Delligatti, c/o Dalemark Ind. 950 Airport Road, Industrial Park, Lakewood, N.J. 08702

[21] Appl. No.: 624,422

[22] Filed: Oct. 21, 1975

[51] Int. Cl.[2] ..... B41F 17/16

[52] U.S. Cl. ..... 101/35; 101/DIG. 3

[58] Field of Search ..... 101/35, 36, 37, 232, 101/45

[56] References Cited

U.S. PATENT DOCUMENTS

| | | | |
|---|---|---|---|
| 2,691,936 | 10/1954 | Farkas et al. | 101/35 |
| 2,825,278 | 3/1958 | Schwisow | 101/35 |
| 2,905,081 | 9/1959 | Jackson | 101/35 |
| 2,910,937 | 11/1959 | Hirschey | 101/228 |
| 2,934,004 | 4/1960 | Barker | 101/35 |
| 2,996,003 | 8/1961 | Worth | 101/331 |
| 3,081,697 | 3/1963 | Delligatti | 101/35 |
| 3,116,684 | 1/1964 | Gottscho et al. | 101/35 |
| 3,299,804 | 1/1967 | Schueller | 101/35 |
| 3,349,702 | 10/1967 | Nesin et al. | 101/416 |
| 3,359,891 | 12/1967 | Price, Jr. | 101/35 |
| 3,453,982 | 7/1969 | Carl | 101/38 R |
| 3,459,125 | 8/1969 | Forslund | 101/35 |
| 3,500,744 | 3/1970 | Lewis | 101/23 |
| 3,589,280 | 6/1971 | Wilde | 101/35 |
| 3,738,260 | 6/1973 | Navi | 101/35 |
| 3,752,067 | 8/1973 | Gill | 101/235 X |
| 3,902,412 | 9/1975 | Pabodie | 101/288 X |
| 3,919,036 | 11/1975 | Reinhart et al. | 101/232 X |

*Primary Examiner*—Louis G. Mancene
*Assistant Examiner*—Paul J. Hirsch
*Attorney, Agent, or Firm*—Sixbey, Bradford & Carlson

[57] ABSTRACT

A bottom coder is provided in which the printing head and its associated inking system are mounted in a drawer type support whereby the top of the device is clear of obstructions such as ink reservoirs and whereby the inking and printing system may be quickly and easily exposed to facilitate cleaning, adjustment and, most importantly, rapid and easy conversion of the copy to be printed to code the desired information on products or packages passing through the machine.

3 Claims, 5 Drawing Figures

BOTTOM CODERS

PRIOR ART

Bottom coders, as the name implies, are machines specifically designed to place some form of code or other indicia on the bottom surface of an article. For example, in many manufacturing operations it is essential that records be kept concerning date of manufacture, or job number, or units produced, etc. In order to identify any given item with the records it is essential that some form of legible indicia be placed on the products or containers containing the product so that in the event it is desired to relate the product to the records, this result can be readily accomplished.

One prime example of the need for record keeping and product identification is the canning or food processing industry where dates of production may be vitally important; where product lot numbers may be important to trace quality of the product back to the raw materials from which derived; and like situations.

The code marking industry has responded to industry needs by developing machinery capable of being incorporated into production lines and which will operate at speeds compatible with production output whereby each item passing through the manufacturing process may be imprinted with information, whatever it might be, which may be necessary to meet the requirements of that particular manufacturing operation. A typical bottom coder is illustrated in U.S. Pat. No. 3,738,260 dated June 12, 1973.

As shown in that patent a bottom coder consists of a cabinet structure which houses driving machinery, and which has a smooth top surface area over which the products, in this case cans or jars, may readily slide.

The articles are conveyed over the surface by a pair of driven, mutually opposed conveyor belts which grip the article as passes between them and convey the article across the sliding surface. At some point during travel over the sliding surface the article is contacted by a printing means projecting up thrugh an aperture in the surface and which is controlled by a sensing means to perform its function each time an article passes over the aperture. Various adjustments can be made to accomodate various sized articles to regulate machine speed and to enable proper location of the printed information on the bottom of the article.

In the known bottom coders access to the actual printing mechanism disposed beneath the article traversed surface is usually through an access door located at the front of the cabinet or pivoted on the sliding surface and containing the aperture through which the article contacting member projects. Obviously in order to service the printing mechanism it is necessary to reach into the interior of the cabinet, a fact which imposes severe limitations on the size and types of tools that can be used, makes it difficult to see and reach various components of the printing mechansim, and, in short, prolongs the down time of the coder and the production line with which it is associated.

THE INVENTION

Having in mind the shortcomings of the prior art coders, the present invention seeks to eliminate the problem of access to the printing mechanism by mounting the mechanism in a drawer type compartment whereby when it is necessary to sevice the mechanism the entire assembly may be moved out of the cabinet structure quickly and easily and can be readily seen and all parts easily reached.

Accordingly, an object of the invention is to provide an easily serviceable bottom coder.

Another object of the invention is to provide a bottom coder in which the printing mechanism may be changed or adjusted with a minimum of "down time" of the apparatus.

Still a further object of the invention is to eliminate access doors and the like in the product traversed surface which doors, unless perfectly mated with the surface, can cause jamming of the machine.

An additional object of the invention is to house the printing mechanism and the ink supply therefore completely within the cabinet structure of the bottom coder and thus avoid the possibility of damage to these components.

The above noted, and other objects of the invention not specifically mentioned but readily apparent to those skilled in the art may be accomplished by the improvement which consists of providing in a bottom coder, a structure including a pair of drawer guides extending parallel to the product traverse surface beneath such surface, a slidable drawer frame mounted in said guides, said frame including a print head support yoke pivotally carried by said drawer frame and swingable vertically from a position where the printing member extends upwardly above the product traversing surface to a lower position where the printing member is positioned below the product traversed surface, and means for moving the printing mechanism to either of its two positions. Ink supply means may be also mounted on said drawer frame and flexible drive means connects the printing assembly to the drive means for the bottom coder.

Having defined the invention broadly herein above, the specific details of an enabling disclosure will become apparent from review of the following detailed description and drawings wherein FIG. 1 is a perspective view of a bottom coder including the improvements contemplated herein FIG. 2 is a top plan view of the printing mechanism FIG. 3 is an elevational sectional view taken along the line 3—3 of FIG. 2

Figure 1:
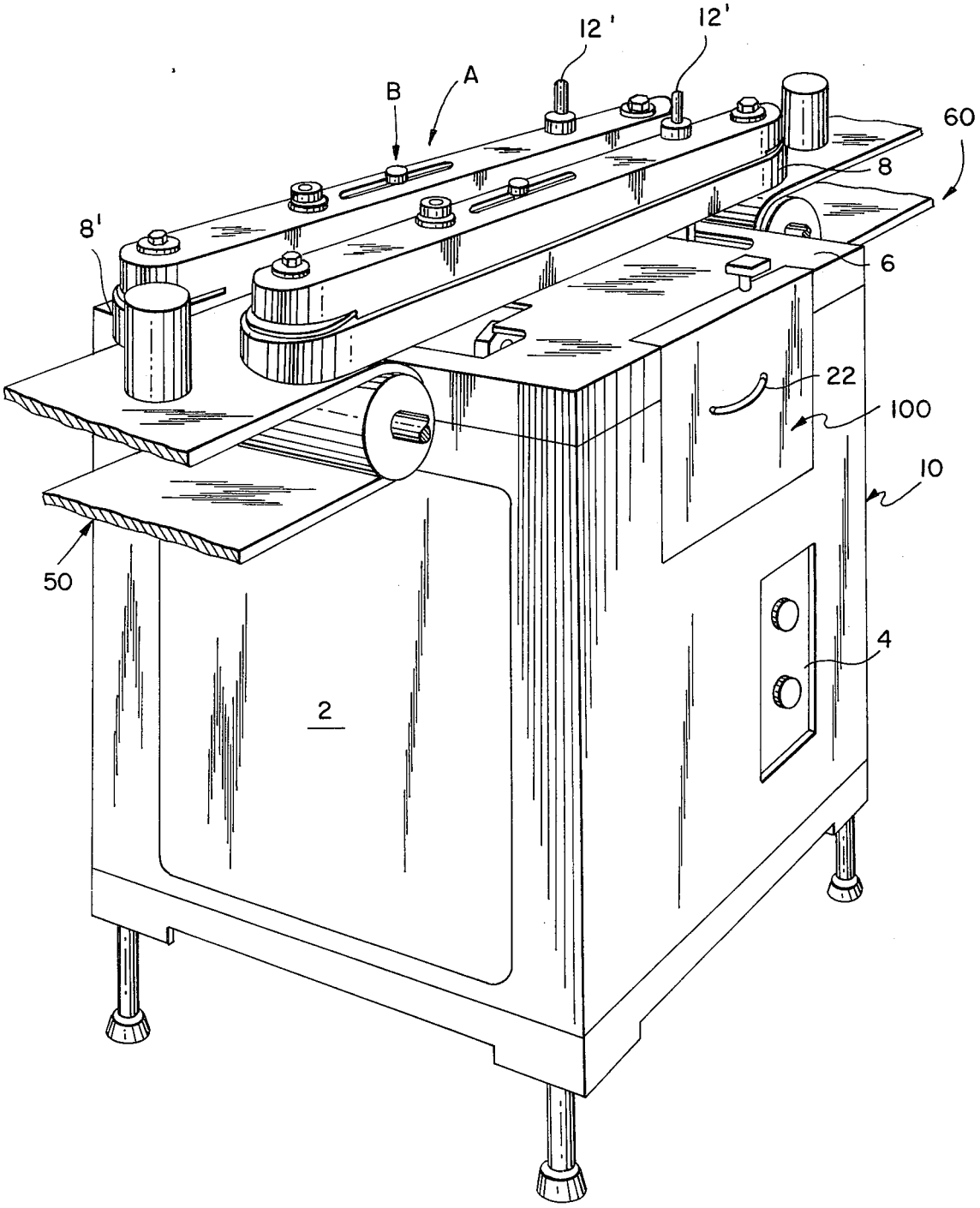

Considering initially FIG. 1, it will be seen that the bottom coder includes a cabinet structure 10 which houses a drive means gearing and the like. The sides of the cabinet are provided with removable access panels 2 (only one shown) while the front of the cabinet is provided with a switch panel 4 for operating the apparatus.

The upper surface 6 of the cabinet is flat and horizontally disposed and preferably at least a portion thereof is fabricated of a wear resistant relative low friction material such as stainless steel or the like to permit of sliding movement of products or containers thereover.

Extending across the top of the upper or product traversing surface 6 of the cabinet 10 is a pair of mutually opposed vertically positioned product conveyor belts 8,8$^1$. These belts 8,8$^1$ are trained around rotatable sprockets so as to form a product transporting means as a product is fed onto the cabinet surface from some other conveying means, such as conveyor belt 50. The belts 8,8$^1$ are driven in syncronism by a drive means (not shown) as is known in the art. As container or the products to be coded enter between the belts they are entrapped between the belts and carried across the top article traversing surface and discharged from the coder onto another conveying means, such as conveyor belt 60. Suitable adjustment means 12.12' are provided whereby the spacing between the belts 8,8[1] may be varied to accomodate products or containers of different size. The mechanism for accomplishing such adjustment is found in the prior art and forms no part of the present invention.

Located at a point approximately half the distance traversed by belts 8 and 8[1], at the location generally designated at A in FIG. 1, is the printing mechanism for imprinting the desired information on the products or containers traversing the cabinet surface. The printing mechansim, among other elements, includes a rotatable printing member which projects through a suitable aperture (see FIG. 2) in the surface 6 just enough to contact each article being traversed across the surface by means of belts 8,8[1].

Coordination of the printing member with movement of the article is affected through an electric eye or some similar sensing mechansim, located at position B, whereby as each container or product triggers the sensing mechansim the printing mechanism operates to rotate the printing member into contact with the bottom of the moving item. Suitable adjustment means, as is conventional, are provided so that the position of the triggering or sensing means relative to the printing means may be varied to accomodate different sized articles.

In the conventional bottom coder, when any adjustment is made to the printing apparatus such as cleaning or change of the indicia to be printed, access to the printing apparatus, is either through the front of cabinet 10 or in some cases via an access door provided in the upper surface of the cabinet adjacent to or surrounding the aperture through which the printing means extends. Also, in at least one of the prior art bottom coders, the ink supply for the printing apparatus is located on the top of the cabinet on surface 6 where it is subject to breakage and, further, is just another obstruction when the machine must be adjusted or repaired.

Figure 2:
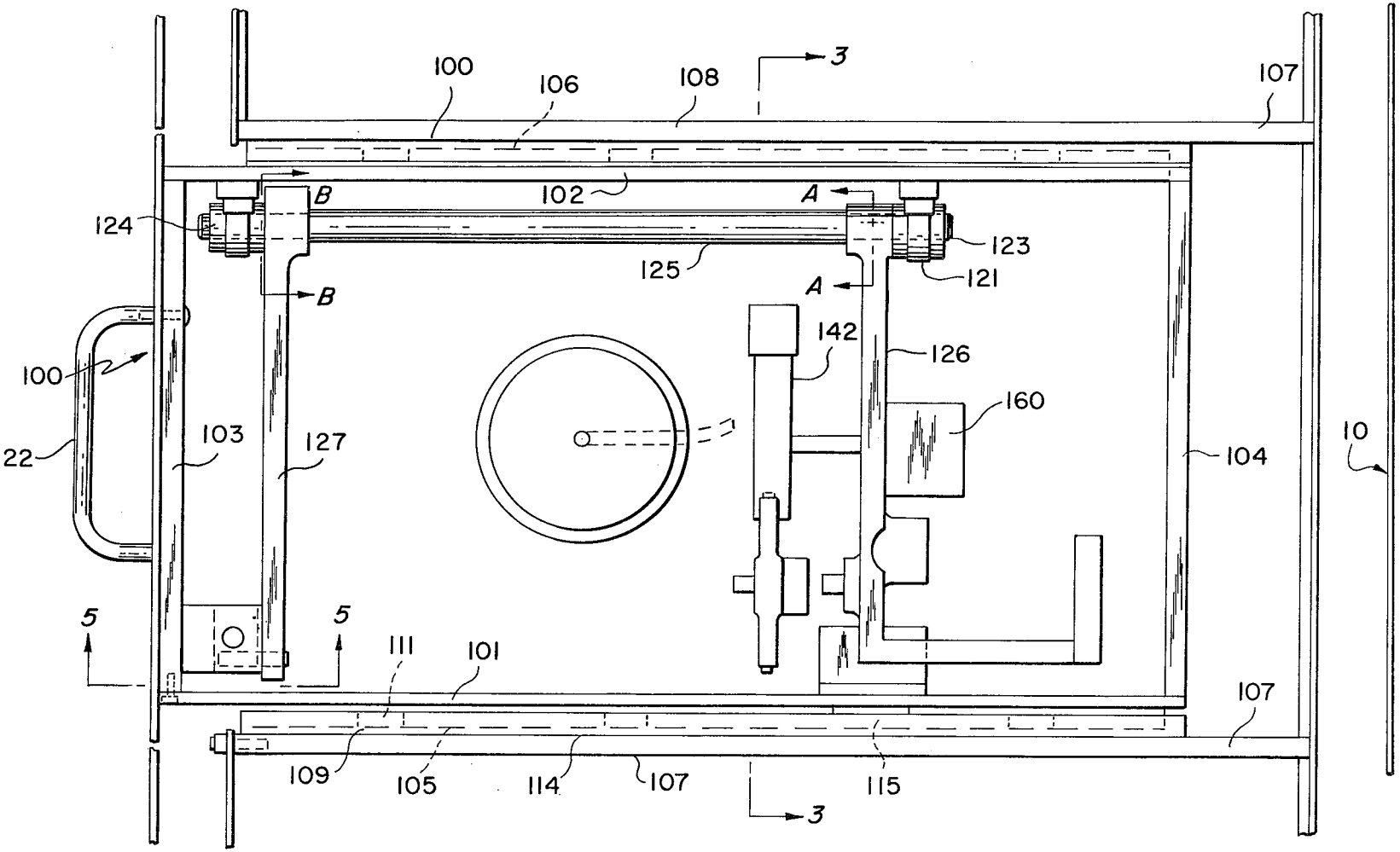

In the present invention, reference being made to FIG. 2 in conjunction with FIG. 1, the printing apparatus is all contained in a drawer 100 which is readily accessable from the front face of the cabinet by means of a drawer pull 22.

Figure 3:
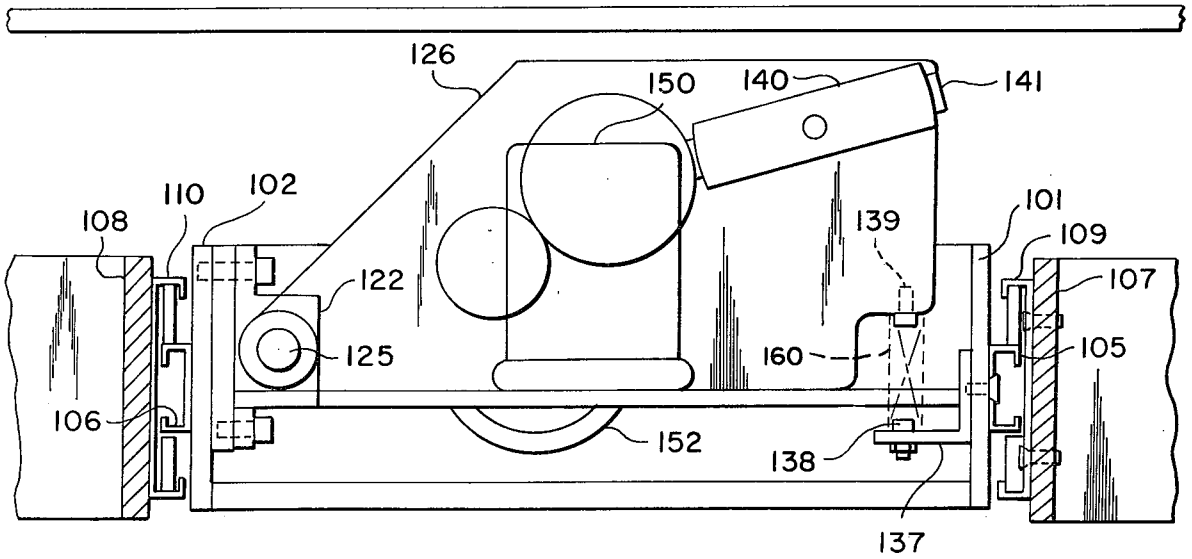
Figure 4:
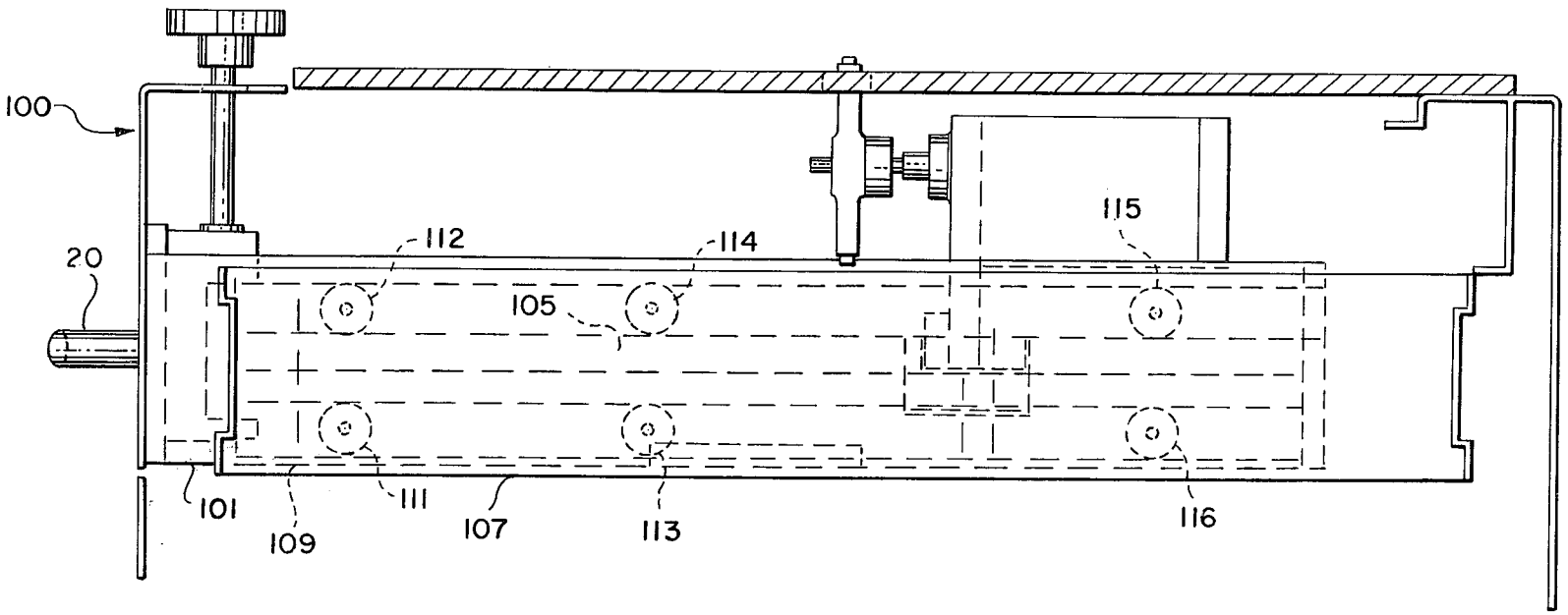
FIG. 4 is a side elevational view of the structure shown in FIG. 2.

As clearly shown in FIGS. 2 and 3 the drawer 100 is comprised of a rectangular frame including side frame members 101, 102 and cross members 103, 104. The side frame members 101, 102 are provided with generally channel shaped longitudinal drawer runners 105, 106, as shown particular in FIG. 2. These drawer runner members are attached to the side frame members by rivets or the like.

Within the cabinet structure there is provided a pair of parallel horizontal support struts 107, 108. These struts extend from the front of the cabinet inwardly toward the product traversing surface and in turn have channel shaped drawer guides 109, 110 affixed thereto by any suitable means. Suitable rollers 111, 112, 113, 114, 115, 116 etc. may be located within the drawer guides 109, 110 to guide the drawer runners in the guides and to reduce friction whereby the runners move easily in the guides. It should be understood, at this point, that the disclosed structure is a most simplified enabling disclosure of the structure and that other drawer guide arrangements can be used if desired.

The side frame member 106 is the support member for a pair of spaced, horizontally aligned trunnions 121, 122 extending inwardly toward the interior of the drawer structure. Mounted for rotation in trunnions 121, 122 and secured against axial movement by nuts 123, 124 is a horizontally disposed rock shaft 125.

Mounted on shaft 125 in spaced parallel relation are a pair of generally horizontally extending arms 126, 127 which in conjunction with rock shaft 125 define a rockable yoke-like support disposed in the interior of the drawer frame.

Arm 127 of the rockable yoke is disposed adjacent the drawer front, while arm 126 defines a part of a printer frame to support an ink roll, transfer roll and printing wheel in a particular relation as will be described hereinafter.

Connected between the drawer frame and yoke arm 127 is a adjustment mechanism whereby the entire yoke assembly may be swung vertically for two purposes; the first to affect adjustment of the pressure of the printing wheel against the items being marked or coded; secondly, to enable lowering of the printing wheel below the product traversing surface from its normal above surface position whereby the drawer may be opened when it is desired to gain access to the printing mechanism.

Figure 5:
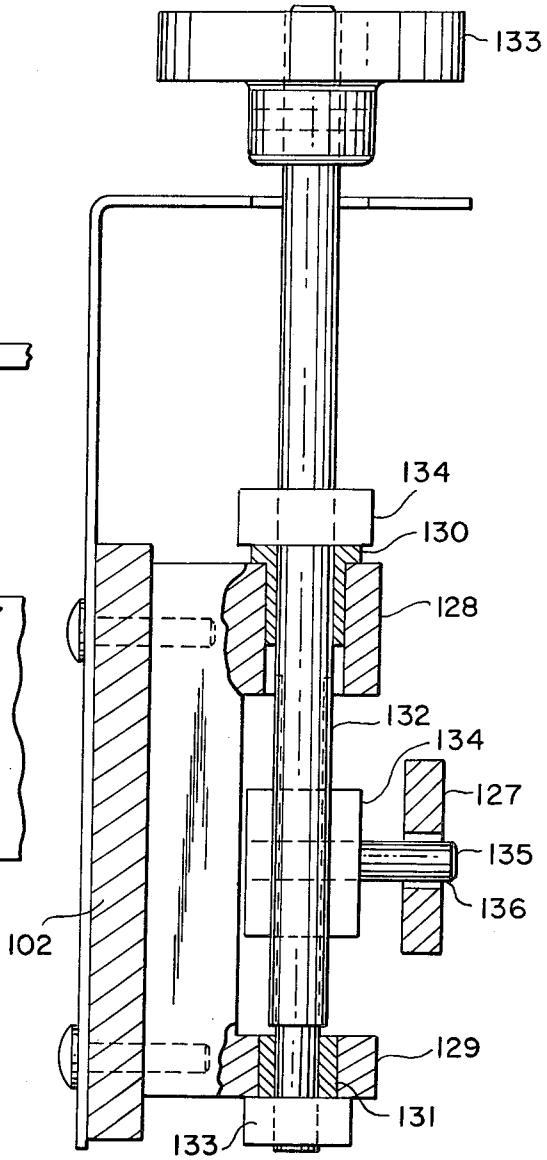
FIG. 5 is an enlarged view taken along the line 5—5 of FIG. 2.

The adjustment means is comprised of a pair of vertically aligned trunnions 128, 129 affixed to cross frame member 102 as clearly shown in FIG. 5. Each of the trunnions is provided with a sleeve type friction reducing bushing 130, 131 respectively which rotatably receives a vertically disposed rotatable drive shaft 132. This drive shaft 132 is locked in the trunnions against axial movement by stop collars 133, 134 respectively, each of which bears against the bushings or trunnions as illustrated. Drive shaft 132 has its upper end disposed above the drawer frame a distance such that when drawer 100 is closed it projects above the top surface 6 of the cabinet. This upwardly projecting end of the drive shaft is connected to a suitable hand wheel 133 which may be manually rotated in either direction.

The portion of the drive shaft 132 between trunnions 127 and 128 is provided with screw threads of a suitable pitch. Engaged on this threaded partion of shaft 132 is a traveler 134 in the form of an internally threaded rectangular block having a pin 135 projecting outwardly from its innermost face; said pin being in engagement with an aperture 136 in yoke arm 127. Thus as the drive shaft is rotated in one direction or the other the traveler is raised or lowered along said shaft and causes the yoke assembly and hence the printing mechanism to be raised and lowered. In order to take up any play in the yoke assembly and to assure that the printing mechansim is properly adjusted, the yoke arm 126 bears against a coil spring 160 which in turn bears against a bracket 137 suitably affixed to the frame member 101. As shown in FIG. 3 the coil spring is held in position by a pair of mutually opposed pin members 138, 139 which engage the ends thereof.

The printing mechanism per se, is not novel and, hence, will not be described in great detail. It suffices to say that is a typical flexographic system utilizing rubber type faces 141 removeably mounted in a diametrically extending, rotating, type support 140. The type is supplied with ink by a transfer roll 142 from an inking roll 143. Inker roll 143 may be of the porous type in which ink introduced into the interior thereof passes by capillary action to the outer surface thereof and is picked up by the transfer roll and carried to the type. Alternatively, the inker roll may be in contact with ink in a fountain or trough which deposits ink on its outer surface for transfer to the type. Irrespective of which system is used, the inker roll is supplied from an ink source 150 via a flexible tube 152, the source comprising a replaceable or refillable reservoir mounted on a support member 153 carried by frame members 101, 102. Regardless of construction, the important fact is that the ink source is housed in an out of the way loction, yet is readily accessible as is the printing mechansim, for servicing, replenishment of ink and change of type face by simply lowering the printing means via hand wheel 134 and pulling drawer 100 out. After such serciving is complete, the drawer is slid back to the closed position, the hand wheel rotated to raise the printing mechanisms so that contact with the items being coded is affected by the type to imprint the desired information thereon.

The printing mechanism is driven by flexible shaft, not shown, through a suitable gear box and clutch 160 from the same power source that drives the belts 8, 8[1] and function in the same manner as disclosed in the prior art such as patent 3,738,260.

Having described the improvement in bottom coding devices, it will be apparent that various changes will occur to those skilled in the art, all falling within the spirit and scope of the appended claims.

What is claimed is:

1. In a bottom coder including a cabinet having an upper horizontal product traversing surface, a pair of mutually opposed drive belts for conveying items to be marked across said product traversing surface, and printing means projecting upwardly through the product traversing surface and located in the path of movement of the products whereby the products are engaged by said belts and transported across said surface contact said printing means; the improvement comprising a drawer structure slideably mounted in said cabinet below said product traversing surface; said printing means being mounted within and supported by said drawer structure; means carried by said drawer structure for raising and lowering said printing means whereby said printing means may be moved to a position below the product traversing surface to enable said drawer to be slid open to a position wherein the printing means is completely external of the cabinet to permit complete access to said printing means, and thereafter said drawer may be closed and said printing means may be raised to a position above the product traversing surface whereby it may contact the products being conveyed thereacross; said means for raising and lowering comprising a frame of generally rectangular form; yoke means mounted on said frame for pivotal movement, said yoke means comprising one arm including means supporting the components of said printing means, said yoke means further comprising another arm in contact with an adjustment means whereby said yoke may be pivotally swung between said upper and lower positions and may be adjusted in its upper position to affect pressure of the printing means against the bottom of the items to be marked.

2. The improvement in bottom coders as defined in claim 1, wherein said adjustment means comprises a vetically positioned drive shaft, a traveler mounted on said drive shaft and in threaded contact therewith, said traveler being in engagement with said one arm of said yoke means whereby upon rotation of said drive shaft in either direction selectively, the printing means may be raised and lowered.

3. The improvements in bottom coders as defined in claim 1, including means for supplying ink to said printing means said means comprising a reservoir mounted within said drawer structure and disposed below the product traversing surface.

* * * * *